US010702738B2

(12) United States Patent
Chiu

(10) Patent No.: US 10,702,738 B2
(45) Date of Patent: Jul. 7, 2020

(54) TREADMILL

(71) Applicant: FITEK FITNESS PRODUCTS INC., Minsyong Township (TW)

(72) Inventor: Jui-Chung Chiu, Minsyong Township (TW)

(73) Assignee: FITEK FITNESS PRODUCTS INC., Minsyong Township (TW)

( * ) Notice: Subject to any disclaimer, the term of this patent is extended or adjusted under 35 U.S.C. 154(b) by 0 days.

(21) Appl. No.: 16/352,725

(22) Filed: Mar. 13, 2019

(65) Prior Publication Data

US 2020/0147447 A1 May 14, 2020

(30) Foreign Application Priority Data

Nov. 12, 2018 (TW) ..... 107215329 U
Dec. 27, 2018 (TW) ..... 107217732 U

(51) Int. Cl.

| | |
|---|---|
| ***A63B 22/02*** | (2006.01) |
| ***A63B 21/015*** | (2006.01) |
| ***A63B 24/00*** | (2006.01) |
| ***A63B 23/04*** | (2006.01) |
| ***A63B 21/00*** | (2006.01) |

(52) U.S. Cl.

CPC .... *A63B 22/0235* (2013.01); *A63B 21/00069* (2013.01); *A63B 21/015* (2013.01); *A63B 23/0405* (2013.01); *A63B 24/0087* (2013.01)

(58) Field of Classification Search

CPC ..... A63B 22/0235; A63B 23/0405; A63B 21/015; A63B 21/00069; A63B 24/0087

See application file for complete search history.

(56) References Cited

U.S. PATENT DOCUMENTS 3,408,067 A * 10/1968 Armstrong ..... A63B 22/02 482/30
4,204,673 A * 5/1980 Speer, Sr. ..... A63B 22/0012 198/817
4,423,864 A * 1/1984 Wiik ..... A63B 22/0012 434/253
4,733,858 A * 3/1988 Lan ..... A63B 23/1209 482/113
5,314,390 A * 5/1994 Westing ..... A63B 21/00178 482/111
5,830,162 A * 11/1998 Giovannetti ..... A61B 5/1038 601/23
6,880,487 B2 * 4/2005 Reinkensmeyer ... A01K 15/027 119/421
7,125,388 B1 * 10/2006 Reinkensmeyer ..... A63B 69/0064 601/5

(Continued)

*Primary Examiner* — Garrett K Atkinson
(74) *Attorney, Agent, or Firm* — DLA Piper LLP (US)

(57) ABSTRACT

A treadmill includes a base frame and an one-way damping device. The one-way damping device includes a rotatable braking plate, an one-way clutch, and a resistance unit. The resistance unit is fixedly mounted to the base frame and abuts against the braking plate. The one-way clutch is sleeved on one of two rotating shafts of the base frame, is not engaged with the braking plate when the rotating shafts are rotated in a first rotational direction, and is engaged with the braking plate when the rotating shafts are rotated in a second rotational direction, which in turn drives the braking plate to co-rotate against a frictional force between the braking plate and the resistance unit.

14 Claims, 12 Drawing Sheets

(56) References Cited

U.S. PATENT DOCUMENTS

| | | | | |
|---|---|---|---|---|
| 7,381,163 | B2 * | 6/2008 | Gordon | A63B 22/02 482/69 |
| 7,621,850 | B2 * | 11/2009 | Piaget | A63B 22/0056 482/54 |
| 8,002,674 | B2 * | 8/2011 | Piaget | A63B 22/0056 482/52 |
| 8,550,962 | B2 * | 10/2013 | Piaget | A63B 22/0056 482/52 |
| 9,833,657 | B2 * | 12/2017 | Wagner | A63B 22/02 |
| 10,046,202 | B2 * | 8/2018 | Butler, Jr. | A63B 22/0235 |
| 10,143,884 | B2 * | 12/2018 | Cei | A63B 23/04 |
| 10,398,933 | B2 * | 9/2019 | Crist | A63B 21/00069 |
| 10,537,766 | B2 * | 1/2020 | Cei | A63B 21/012 |
| 10,561,883 | B2 * | 2/2020 | Bayerlein | A63B 21/157 |
| 2016/0263429 | A1 * | 9/2016 | Wagner | A63B 21/00069 |
| 2016/0339294 | A1 * | 11/2016 | Blach | A63B 21/00058 |
| 2017/0001075 | A1 * | 1/2017 | Butler, Jr. | A63B 24/0087 |
| 2017/0027803 | A1 * | 2/2017 | Agrawal | A61B 5/224 |
| 2017/0182356 | A1 * | 6/2017 | Cei | A63B 22/0207 |
| 2018/0093130 | A1 * | 4/2018 | Wagner | A63B 22/0285 |
| 2018/0236291 | A1 * | 8/2018 | Bayerlein | A63B 23/04 |
| 2019/0217153 | A1 * | 7/2019 | Bayerlein | A63B 21/0053 |

* cited by examiner

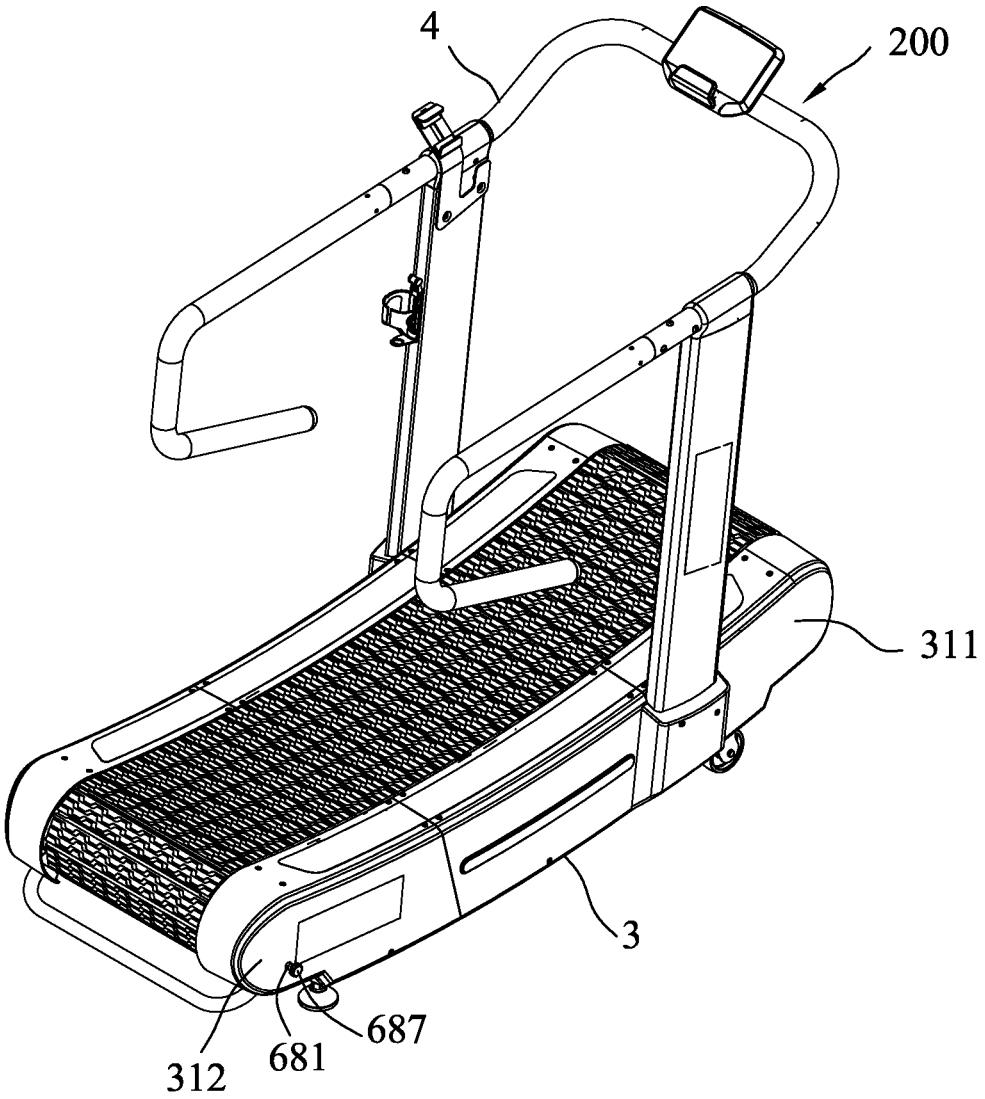
FIG.8
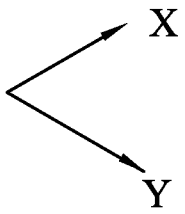

TREADMILL

CROSS-REFERENCE TO RELATED APPLICATION

This application claims priority of Taiwanese Patent Applications No. 107215329, filed on Nov. 12, 2018, and No. 107217732, filed on Dec. 27, 2018.

FIELD

The disclosure relates to a type of exercise equipment, and more particularly to a treadmill.

BACKGROUND

A conventional treadmill having a treadmill belt is usually built with a safety mechanism, which ensures safety of a user when boarding onto the treadmill. The safety mechanism locks rotation of the treadmill belt in one direction, thus preventing the possibility of user slipping due to backward rotation of the treadmill belt. As such, the treadmill belt is no longer operable to rotate in the other direction, thereby resulting in a relatively poor flexibility in use.

SUMMARY

Therefore, an object of the disclosure is to provide a treadmill that can alleviate the drawback of the prior art.

According to the disclosure, the treadmill includes a base frame, a treadmill belt, and an one-way damping device. The base frame includes a frame body that has a front end portion and a rear end portion opposite to the front end portion in a front-rear direction, and two rotating shafts that are respectively mounted to the front and rear end portions of the frame body. Each of the rotating shafts is rotatable relative to the frame body about a rotational axis which extends in a left-right direction transverse to the front-rear direction.

The treadmill belt is trained on the rotating shafts, and has a top section that is defined between top ends of the rotating shafts. The top section is rearwardly movable around the rotating shafts to drive each of the rotating shafts to rotate about the rotational axis in a first rotational direction, and is forwardly movable around the rotating shafts to drive each of the rotating shafts to rotate about the rotational axis in a second rotational direction which is opposite to the first rotational direction.

The one-way damping device includes a braking plate, an one-way clutch, and a resistance unit. The braking plate is rotatable about a rotational axis extending in the left-right direction. The one-way clutch is sleeved on one of the rotating shafts, is not engaged with the braking plate when the top section of the treadmill belt is moved rearwardly, and is engaged with the braking plate when the top section of the treadmill belt is moved forwardly such that rotation of the one of the rotating shafts in the second rotational direction drives the braking plate to rotate in the second rotational direction via the one-way clutch. The resistance unit is fixedly mounted to the frame body and abuts against the braking plate so that, when the top section of the treadmill belt is moved forwardly, the braking plate is rotated in the second rotational direction against a frictional force between the braking plate and the resistance unit.

BRIEF DESCRIPTION OF THE DRAWINGS

Other features and advantages of the disclosure will become apparent in the following detailed description of the embodiment with reference to the accompanying drawings, of which:

FIG. 8 is a perspective view of a third embodiment according to the disclosure;

DETAILED DESCRIPTION

Figure 1:
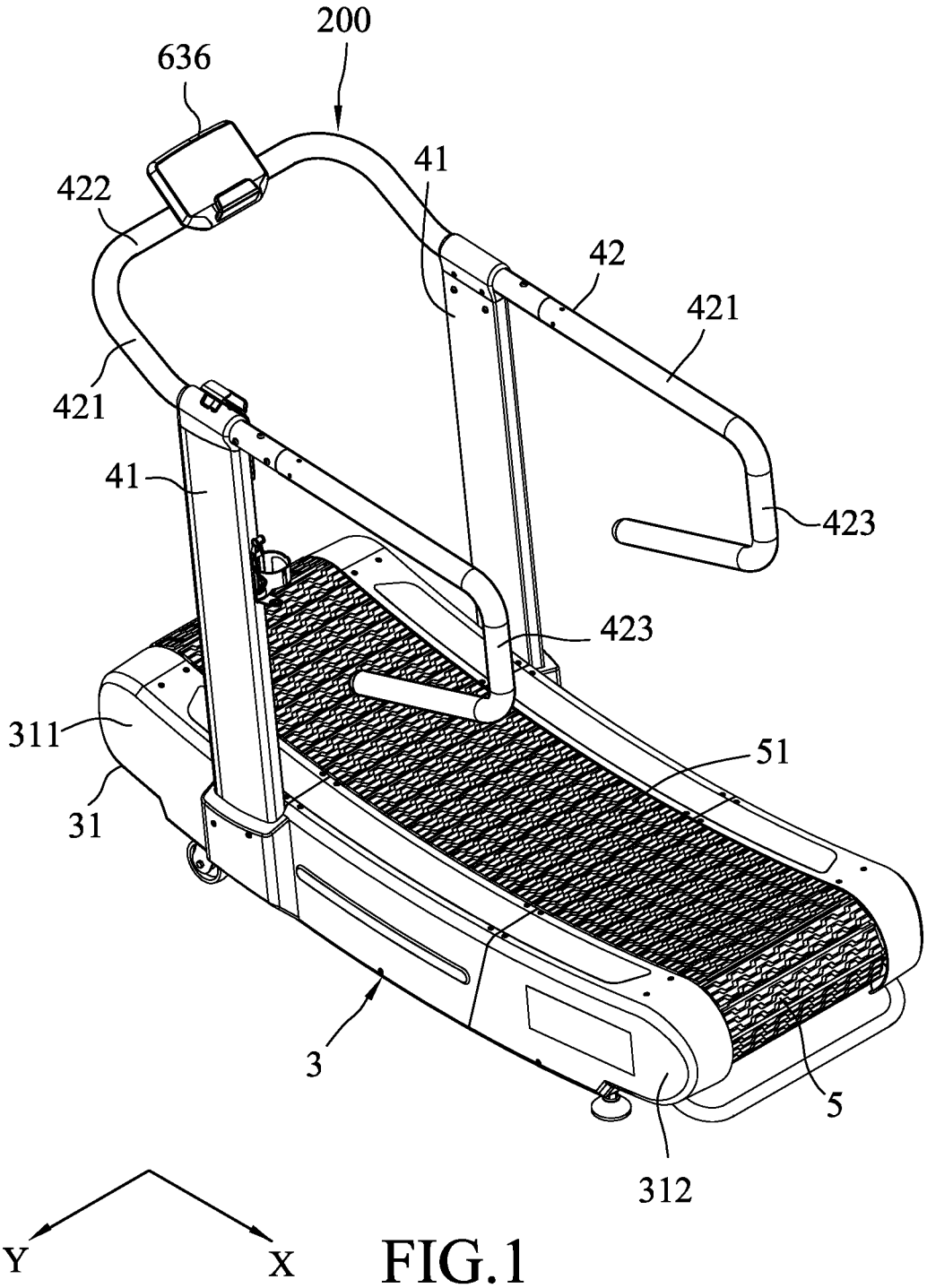
FIG. 1 is a perspective view of a first embodiment of a treadmill according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
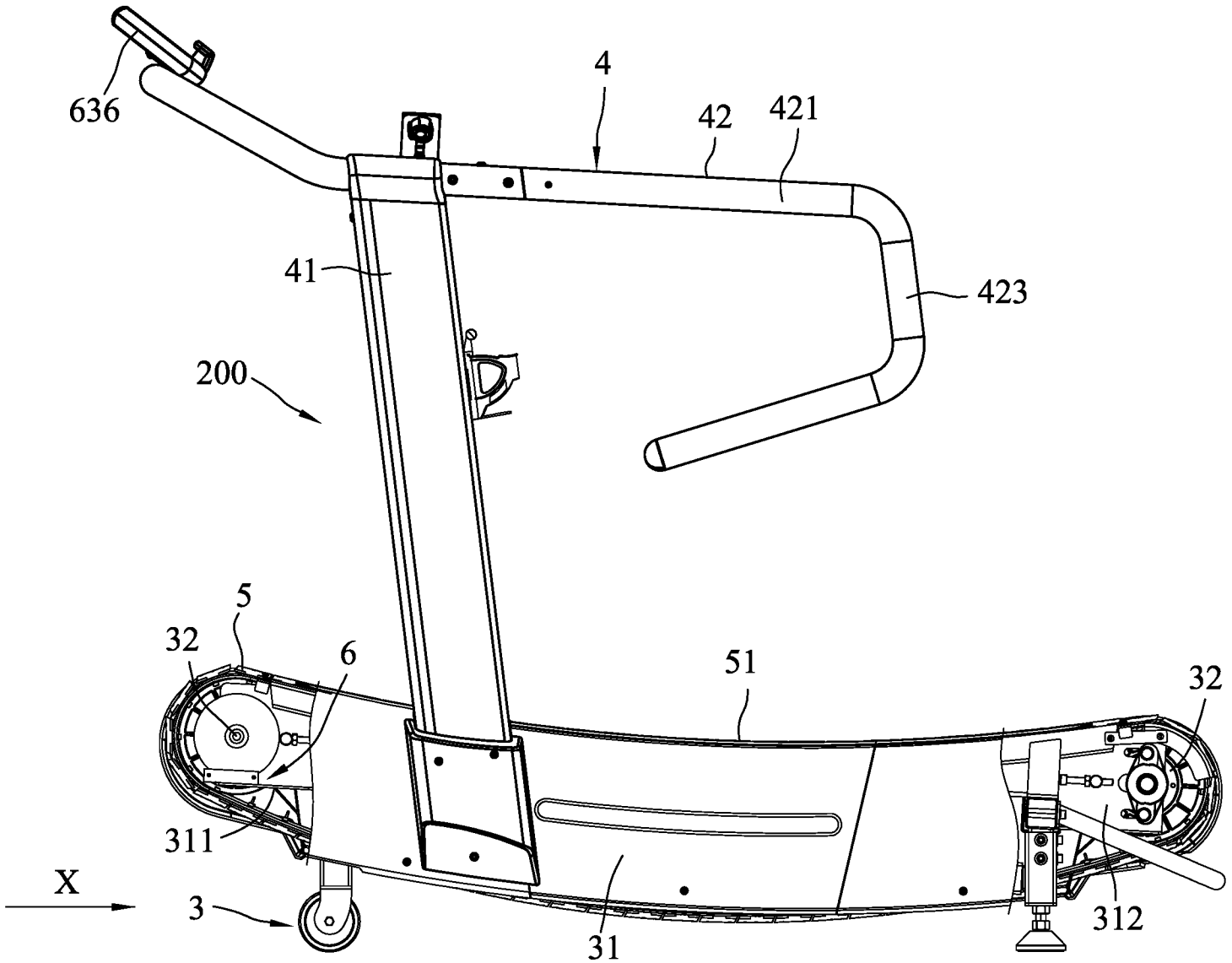
FIG. 2 is a partly sectional side view of the first embodiment.
Figure 3:
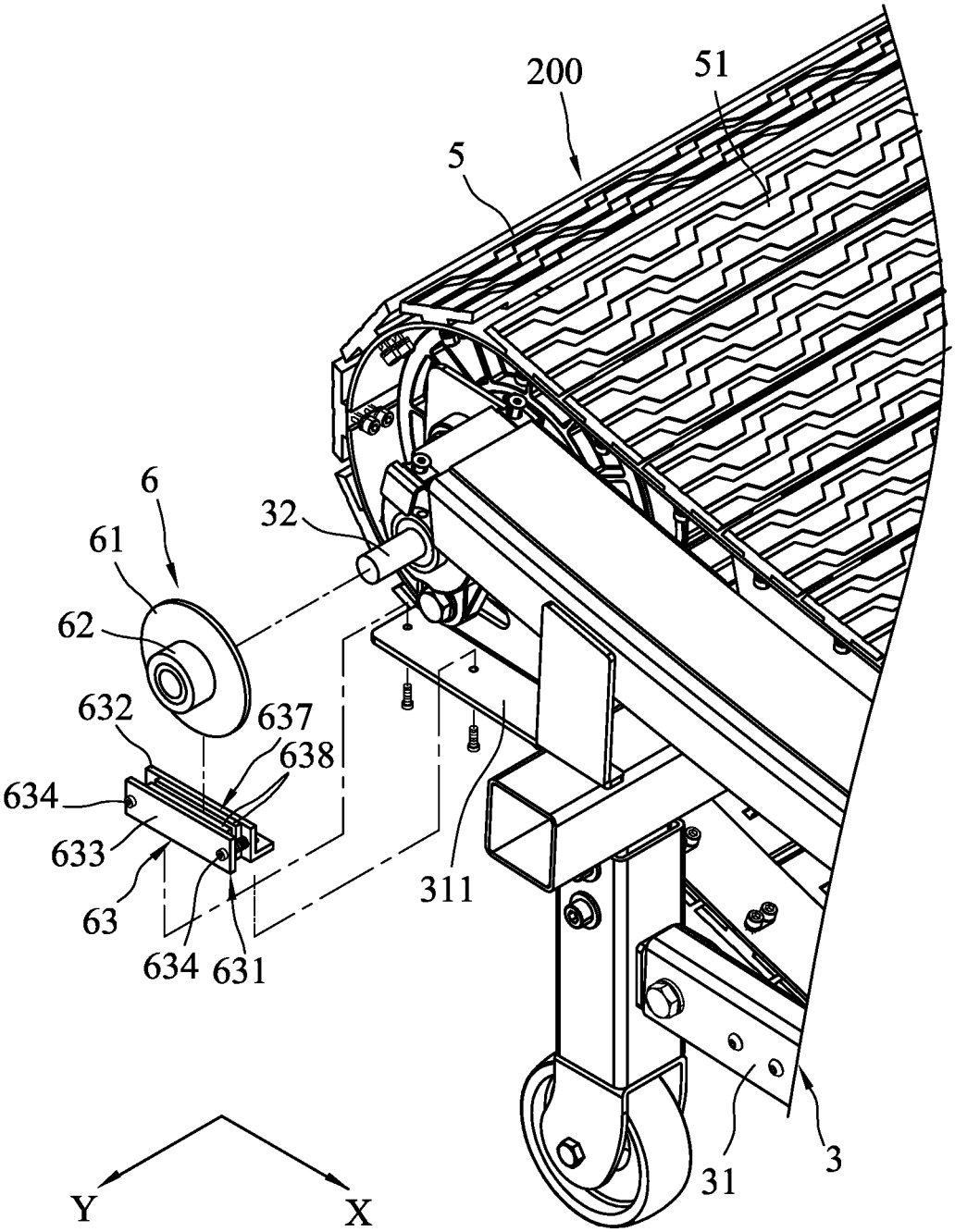
FIG. 3 is a fragmentary partly exploded perspective view of the first embodiment.

Referring to FIGS. 1 to 3, an embodiment of a treadmill 200 according to the disclosure includes a base frame 3, a handrail unit 4, a treadmill belt 5 and an one-way damping device 6.

The base frame 3 includes a frame body 31 that has a front end portion 311 and a rear end portion 312 opposite to the front end portion 311 in a front-rear direction (X), and two rotating shafts 32 that are respectively mounted to the front and rear end portions 311, 312 of the frame body 31. Each of the rotating shafts 32 is rotatable relative to the frame body 31 about a rotational axis which extends in a left-right direction (Y) transverse to the front-rear direction (X).

The handrail unit 4 includes two support frames 41 that are fixedly and respectively mounted to opposite left and right ends of the frame body 31 of the base frame 3, and a handgrip 42 that is mounted to a top end of the support frames 41. Each of the support frames 41 has a bottom end connected fixedly to the frame body 31. The handgrip 42 has two side rail sections 421 that extend substantially in the front-rear direction (X) and that are respectively and fixedly mounted on top ends of the supporting frames 41, a front rail section 422 that extends in the left-right direction (Y) and that interconnects front ends of the side rail sections 421, and two hook-shaped tail sections 423. Each of the hook-shaped tail sections 423 has a first part extending downwardly from a rear end of a respective one of the side rail sections 421, and a second part extending forwardly from a bottom end of the first part.

The treadmill belt 5 is trained on the rotating shafts 32 and has a top section 51 that is defined between top ends of the rotating shafts 32. The top section 51 is rearwardly movable around the rotating shafts 32 to drive each of the rotating shafts 32 to rotate about the rotational axis in a first rotational direction, and is forwardly movable around the rotating shafts 32 to drive each of the rotating shafts 32 to rotate about the rotational axis in a second rotational direction, which is opposite to the first rotational direction.

Figure 4:
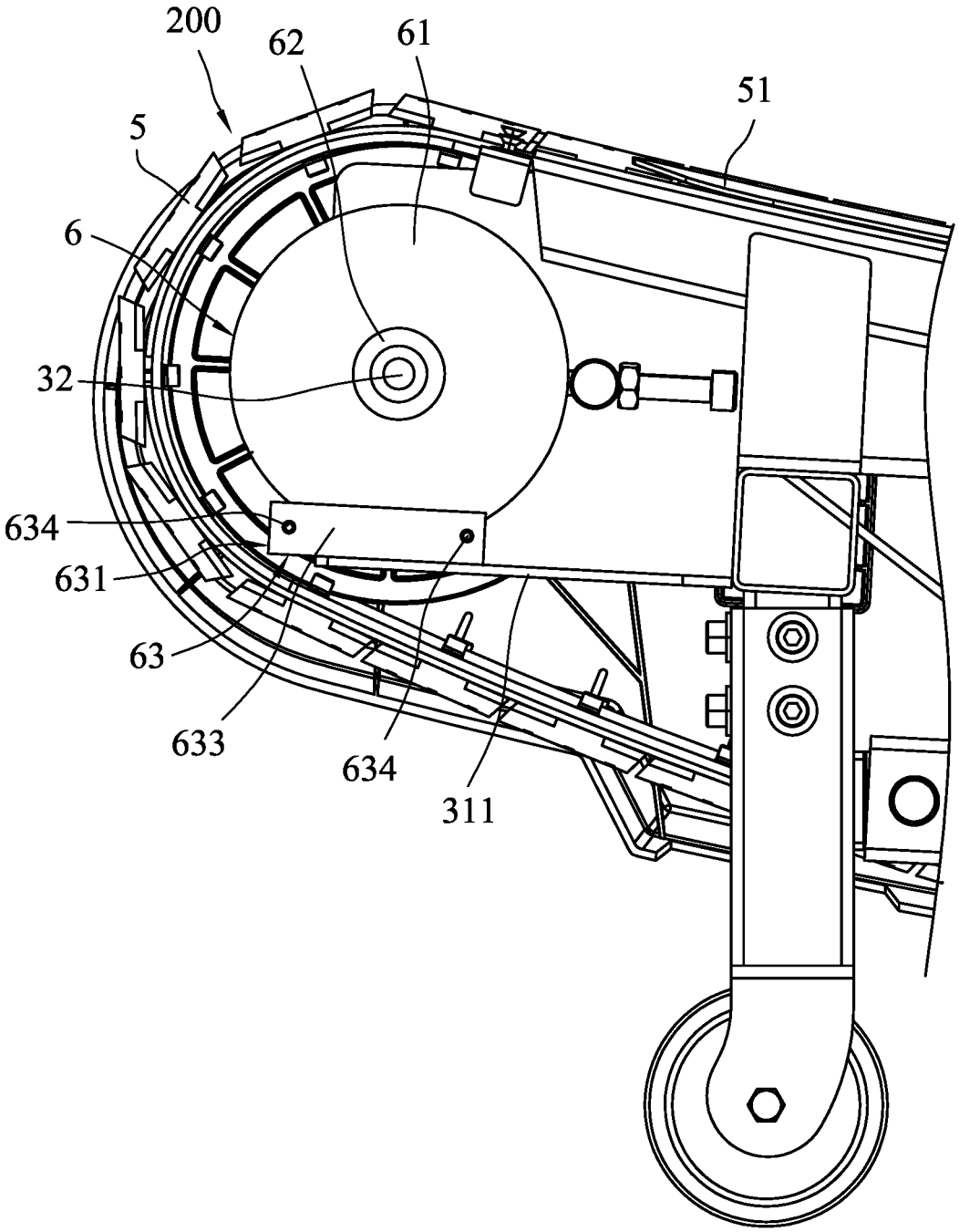
FIG. 4 is a fragmentary side view of the first embodiment.
Figure 5:
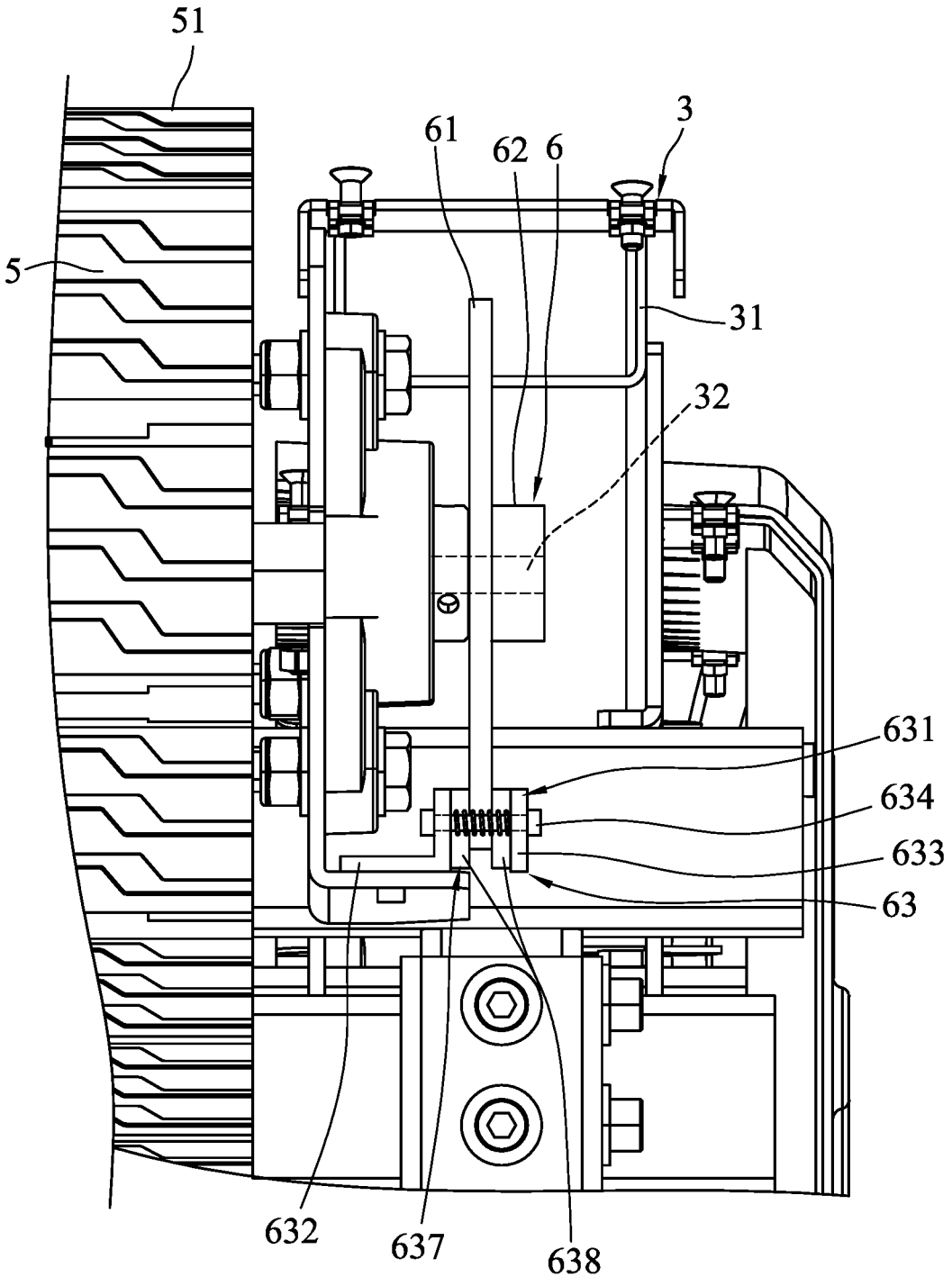
FIG. 5 is a fragmentary front view of the first embodiment.

Referring to FIGS. 3 to 5, the one-way damping device 6 includes a braking plate 61 that is rotatable about a rotational axis extending in the left-right direction (Y). In this embodiment, the braking plate 61 is sleeved coaxially on one of the rotational shafts 32, and the rotational axis of the braking plate 61 overlaps the rotational axis of the one of the rotational shafts 32. The one-way damping device 6 further includes an one-way clutch 62 that is sleeved on the one of the rotating shafts 32, and a resistance unit 63 that is fixedly mounted to the front end portion 311 of the frame body 31 and that abuts against the braking plate 61. In this embodiment, the one-way damping device 6 is mounted to the left end of the frame body 31 and is connected to the rotating shaft 32 mounted to the front end portion 311 of the frame body 31, but may be mounted to the right end of the frame body 31 and/or be connected to the rotating shaft 32 mounted to the rear end portion 312 of the frame body 31 in other embodiments.

The resistance unit 63 includes an adjusting subunit 64 and a friction producing subunit 65. The adjusting subunit 64 has a stationary seat 641 that is fixedly mounted to the frame body 31, a movable seat 642 that is spaced apart from the stationary seat 641 in the left-right direction (Y), at least one adjusting members 643, and at least one resilient members 644. In this embodiment, the adjusting subunit 64 includes two adjusting members 643 and two resilient members 644.

The stationary seat 641 and the movable seat 642 are disposed respectively at opposite sides of the braking plate 61. In this embodiment, the stationary seat 641 is disposed to the right of the braking plate 61, and the movable seat 642 is disposed to the left of the braking plate 61 and the stationary seat 641.

The adjusting members 643 are spaced apart in the front-rear direction (X) and extend in the left-right direction (Y) to interconnect the stationary seat 641 and the movable seat 642. The adjusting members 643 are operable to adjust a distance between the stationary seat 641 and the movable seat 642. In this embodiment, the adjusting members 643 are screws that threadedly engage the stationary seat 641 and the movable seat 642, and are rotatable to move the movable seat 642 in the left-right direction (Y) relative to the stationary seat 641.

In this embodiment, each of the resilient member 644 is sleeved on a respective one of the adjusting members 643, and has two opposite ends respectively and resiliently abutting against the stationary seat 641 and the movable seat 642.

The friction producing subunit 65 includes two resistance members 651 that are respectively and fixedly connected to the stationary seat 641 and the movable seat 642, and that abut against the braking plate 61 (i.e., the resistance members 651 cooperatively clamp the braking plate 61 therebetween) for generating a frictional force between the braking plate 61 and the resistance members 651. In this embodiment, a user rotates each of the adjusting members 643 to adjust the distance between the stationary seat 641 and the movable seat 642 in the left-right direction (Y), which in turn adjusts the magnitude of the frictional force. In other embodiments, adjusting the magnitude of the frictional force can be achieved by using braking mechanism commonly seen in bicycles or flywheels instead.

Referring back to FIGS. 1, 3 and 5, for different exercising uses of the treadmill 200, the user may apply walking or running force onto the treadmill belt 5 to drive the top section 51 of the treadmill belt 5 to move in one of two opposite directions: one direction for regular running exercise, and the other direction for leg muscle training.

In order to undergo regular running exercise, the user continuously drives the top section 51 to move rearwardly. During this state, the one-way clutch 62 is not engaged with the braking plate 61, so that the rotating shafts 32 can easily rotate in the first rotational direction.

On the other hand, to undergo leg muscle training, the user may turn toward the rear end portion 312 of the frame body 31 to continuously drives the top section 51 to move forwardly. During this state, the one-way clutch 62 is engaged with the braking plate 61, such that rotation of the one of the rotating shafts 32 (i.e., the front one of the rotating shafts 32) in the second rotational direction drives the braking plate 61 to rotate as well via the one-way clutch 62. Notably, since the braking plate 61 rotates relative to the resistance unit 63, the frictional force is formed therebetween to impede the rotation of the braking plate 61 and the rotating shafts 32 in the second rotational direction. As such, the user may hold onto the tail sections 423 of the handgrip 42 to properly apply more walking or running force onto the treadmill 5 to keep the top section 51 moving forwardly against the frictional force.

Figure 6:
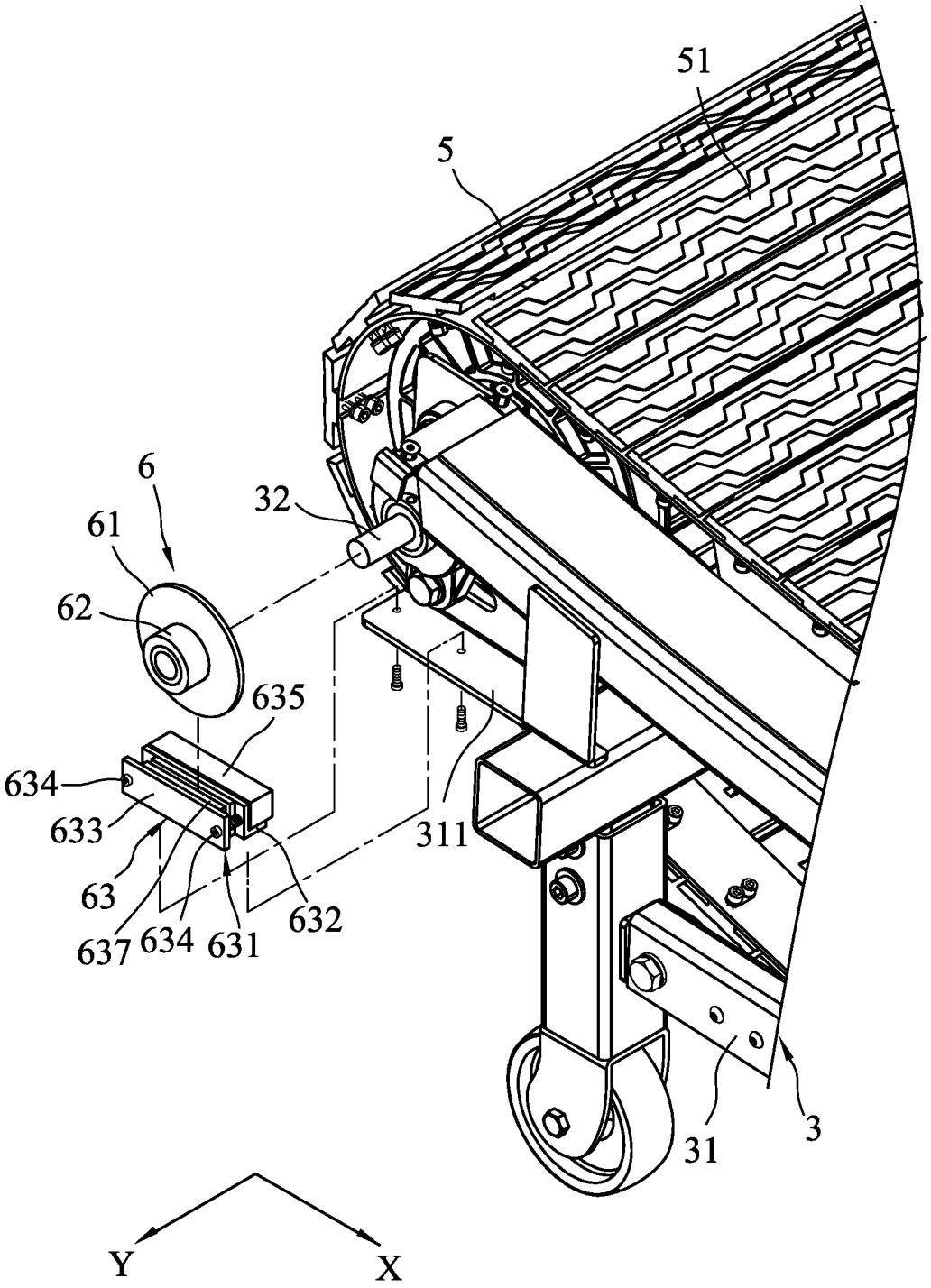
FIG. 6 is a fragmentary partly exploded perspective view of a second embodiment according to the disclosure.
Figure 7:
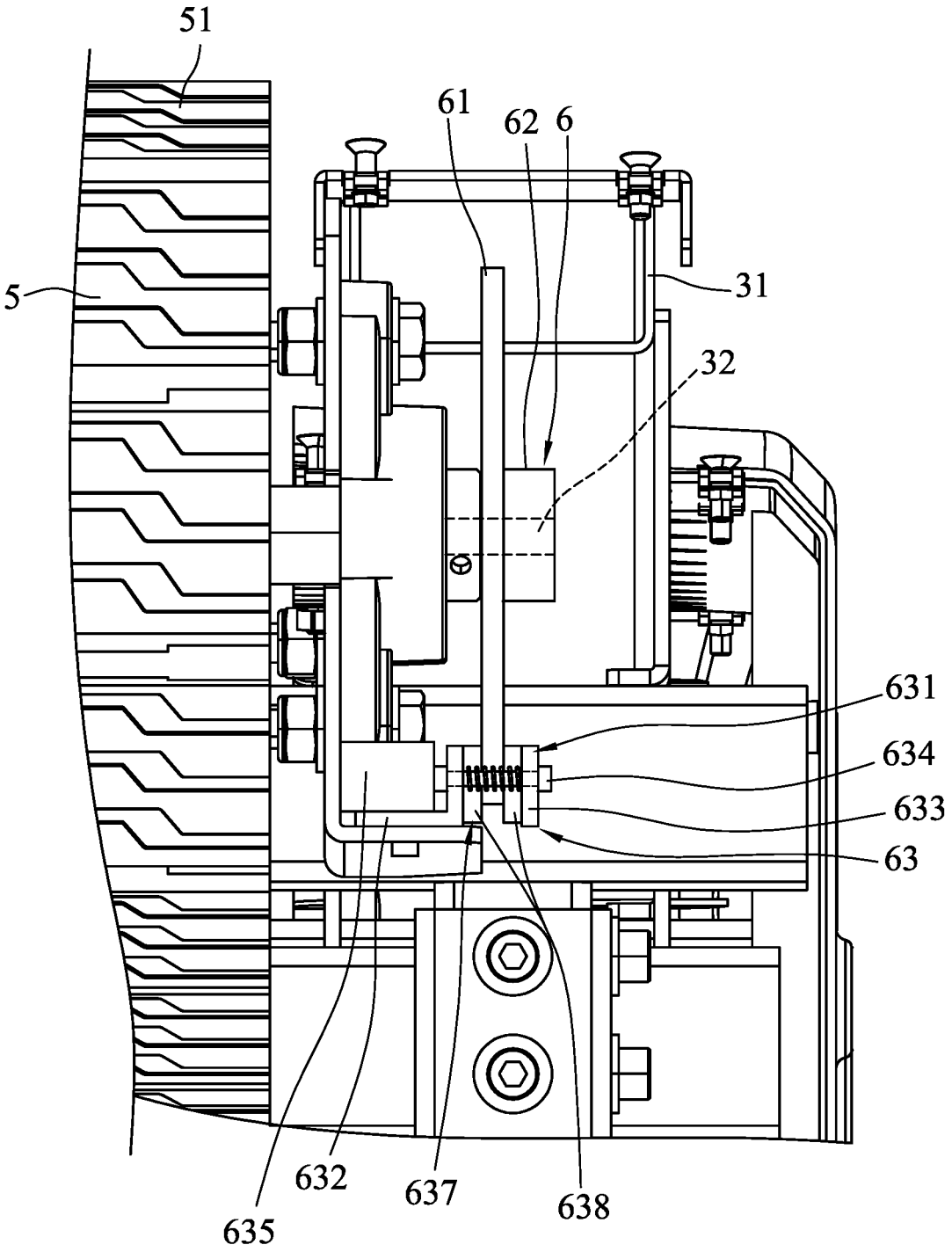
FIG. 7 is a fragmentary front view of the second embodiment.

Referring to FIGS. 1, 6 and 7, the second embodiment of the disclosure is similar to the first embodiment, with differences in the design of the resistance unit 63. In the second embodiment, the resistance unit 63 further includes a driver 66 that is mounted to the frame body 31 and that is connected to the adjusting members 643, and a controller 67 that is mounted to the handrail 42 and that is electrically connected to the driver 66.

The controller 67 allows the user to facilitate operation of the driver 66, which is operable to be turned on for driving the adjusting members 643 to adjust the distance between the stationary seat 641 and the movable seat 642. In the embodiment, the driver 66 is primarily driven by electric motors. Overall, the second embodiment enables remote control of the adjusting members 643.

Figure 9:
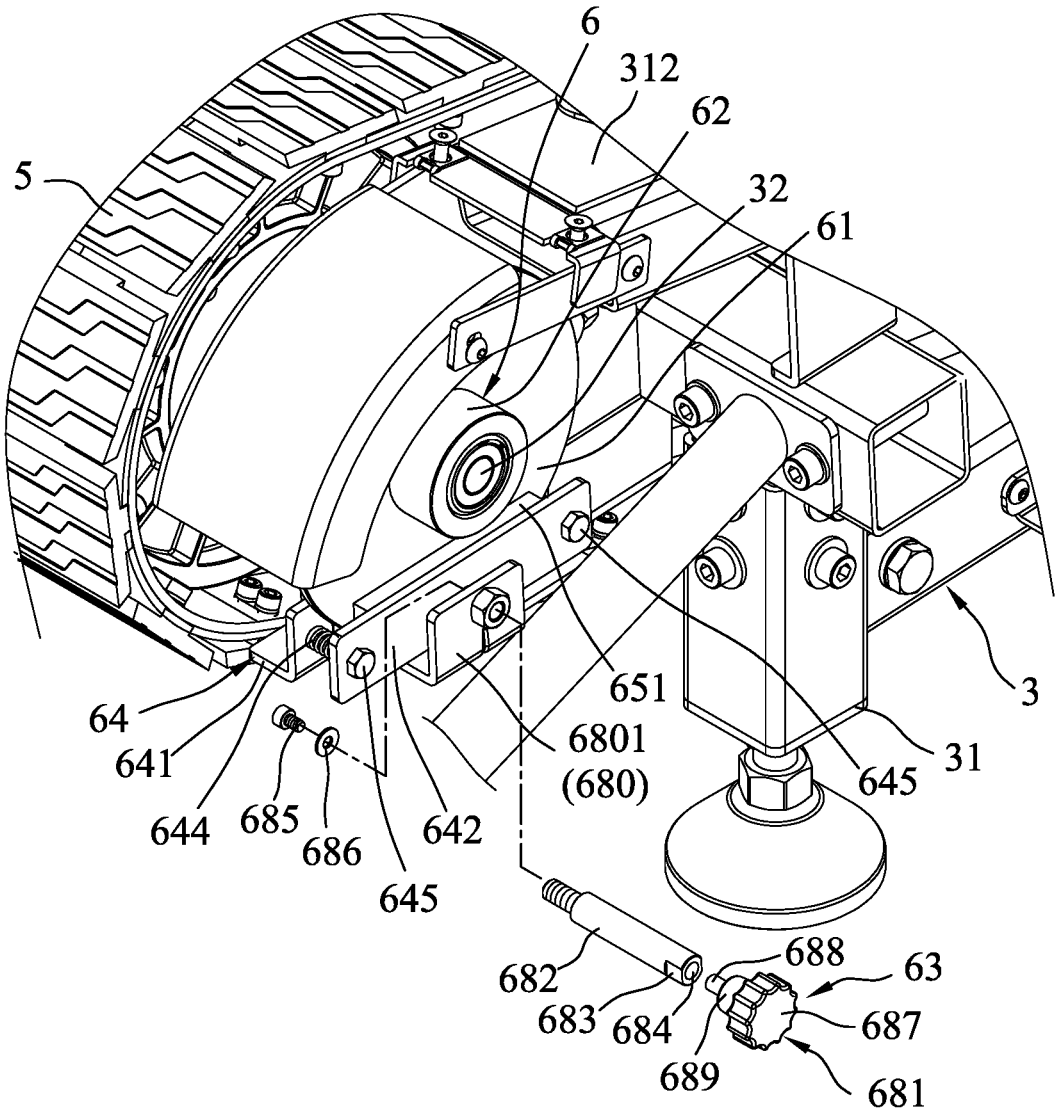
FIG. 9 is a fragmentary partly exploded perspective view of the third embodiment.
Figure 10:
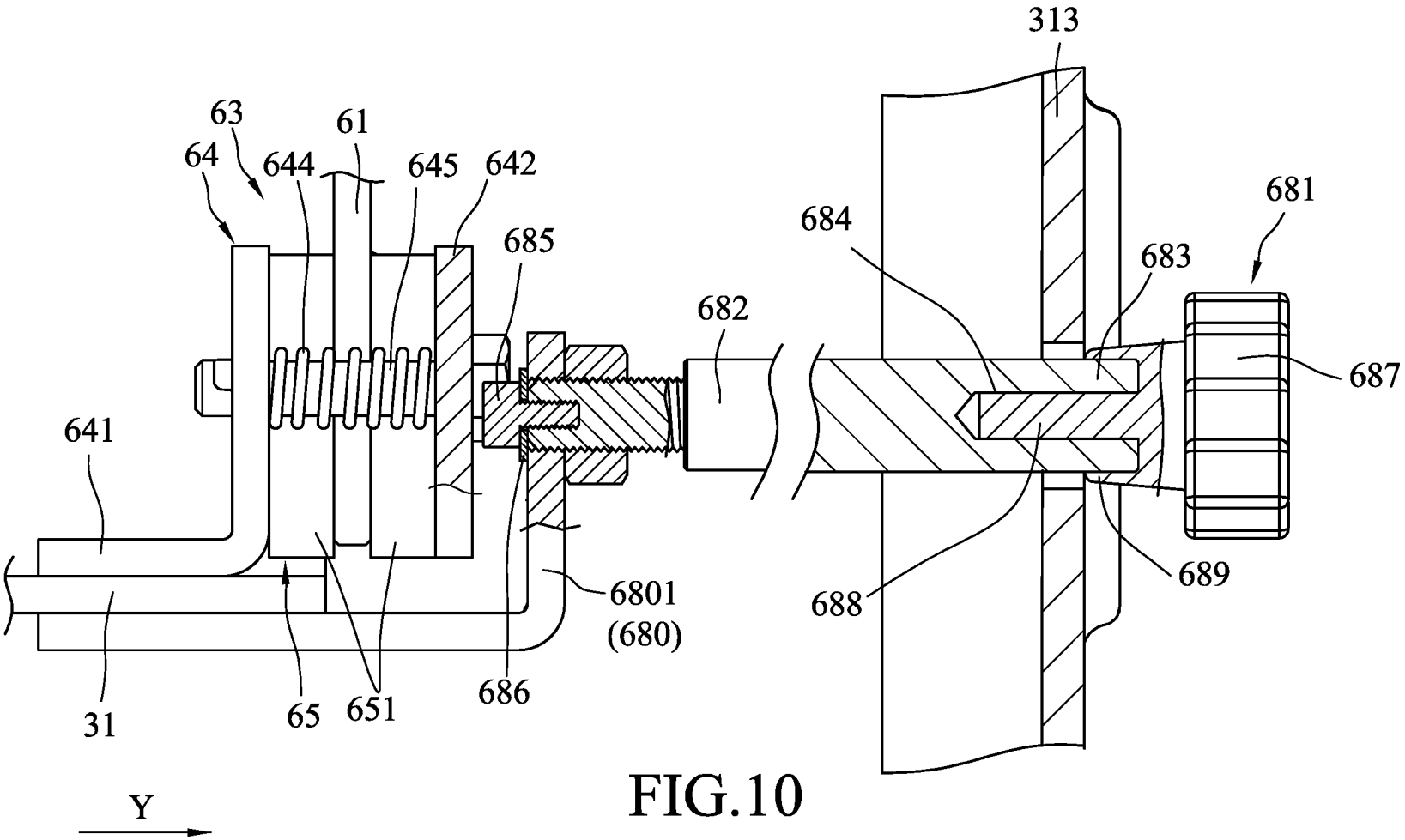
FIG. 10 is a fragmentary, partly sectional rearview of the third embodiment.

Referring to FIGS. 8 to 10, the third embodiment of the disclosure is similar to the first embodiment, with differences in the design of the adjusting subunit 64. In this embodiment, the one-way damping device 6 is mounted to the right end of the frame body 31 and is connected to the rotating shaft 32 mounted to the rear end portion 312 of the frame body 31. The adjusting subunit 64 has a stationary seat 641 that is fixedly mounted to the frame body 31, two guiding members 645 that are fixedly and non-rotatably mounted to the stationary seat 641, a movable seat 642 that is connected to the guiding members 645, two resilient members 644 (only one is visible), an adjusting base 680 that is fixedly mounted to the frame body 31, and an adjusting screw subunit 681.

The guiding members 645 are spaced apart in the front-rear direction (X) and extend in the left-right direction (Y). The stationary seat 641 is disposed to the left of the braking plate 61, and the movable seat 642 is disposed to the right of the braking plate 61 and the stationary seat 641. The movable seat 642 is connected to the guiding members 645 and is movable in the left-right direction (Y) relative to the stationary seat 641. Each of the resilient members 644 is sleeved to a respective one of the guiding members 645, and has two opposite ends respectively and resiliently abutting against the stationary seat 641 and the movable seat 642.

Figure 11:
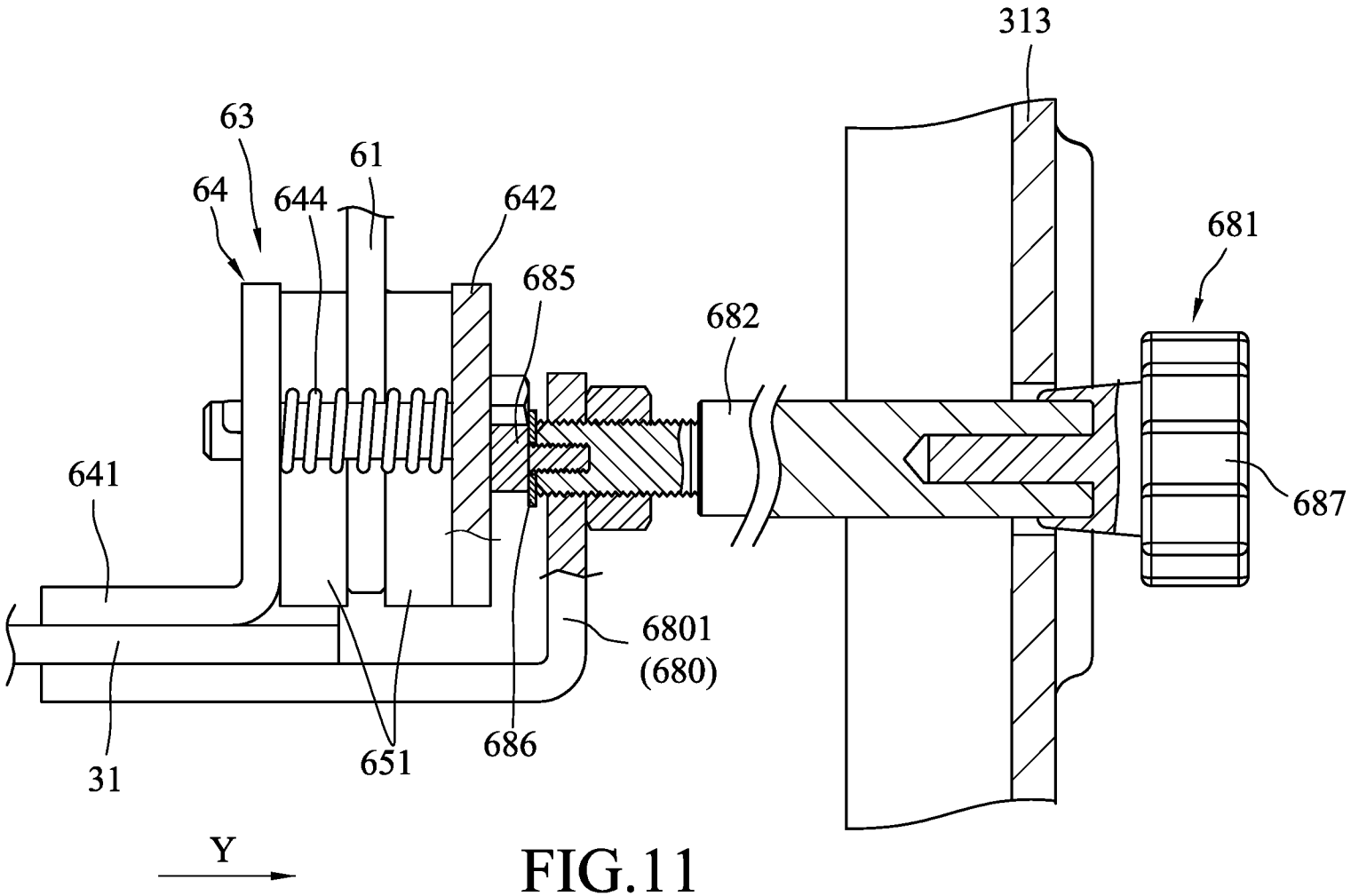
FIG. 11 is a view similar to FIG. 10, illustrating an adjusting screw subunit being driven to push a movable seat.

The adjusting base 680 has a coupling segment 601 that is disposed at aside of the movable seat 642 which is opposite to the stationary seat 641 in the left-right direction (Y) and that is spaced apart from the movable seat 642. Referring to FIGS. 9 to 11, The adjusting screw subunit 681 has a screw 682 that threadedly extends in the left-right direction (Y) through the coupling segment 6801 of the adjusting base 680, and a contact member 685 that is removably mounted to one end of the screw 682.

The contact member 685 is disposed between the coupling segment 6801 of the adjusting base 680 and the movable seat 642. The adjusting screw subunit 681 further has a retaining member 686 that is mounted to the screw 682, that is disposed at a side of the contact member 685 opposite to the movable seat 642 and between the coupling segment 6801 of the adjusting base 680 and the movable seat 642, that expands radially and outwardly from the screw 682 and that prevents the screw 682 to be disengaged from the adjusting base 680.

The adjusting screw subunit 681 further has a knob 687 that is co-rotatably mounted to an opposite end 683 of the screw 682, and that is implemented for ease of access for the user to manually drive rotation of the screw 682 relative to the adjusting base 680, which in turn drives movement of the screw 682 in the left-right direction (Y) for adjusting the distance between the stationary seat 641 and the movable seat 642. When the knob 687 is rotated in a first rotational direction, the contact member 685 is driven to abut against the movable seat 642 to push the movable seat 642 toward the stationary seat 641, which progressively increases the frictional force generated by the friction producing subunit 65. On the other hand, when the knob 687 is rotated in a second rotational direction opposite to the first rotational direction, the contact member 685 is pulled away, and the resilient members 684 push the movable seat 642 away from the stationary seat 641, which effectively reduces the frictional force generated. In this embodiment, the knob 687 is also designed to be removably mounted to the screw 682 to prevent unintentional adjustment. The screw 682 is formed with an insertion hole 684 at the opposite end 683 of the screw 682, and the knob 687 has an inner positioning portion 688 fittingly engaged to the insertion hole 684. In addition, shape of the opposite end 683 of the screw 682 is designed in such a way to be fittingly engaged with an outer positioning portion 689 of the knob 687 to ensure that the screw 682 and the knob 687 are co-rotatable with each other.

Figure 12:
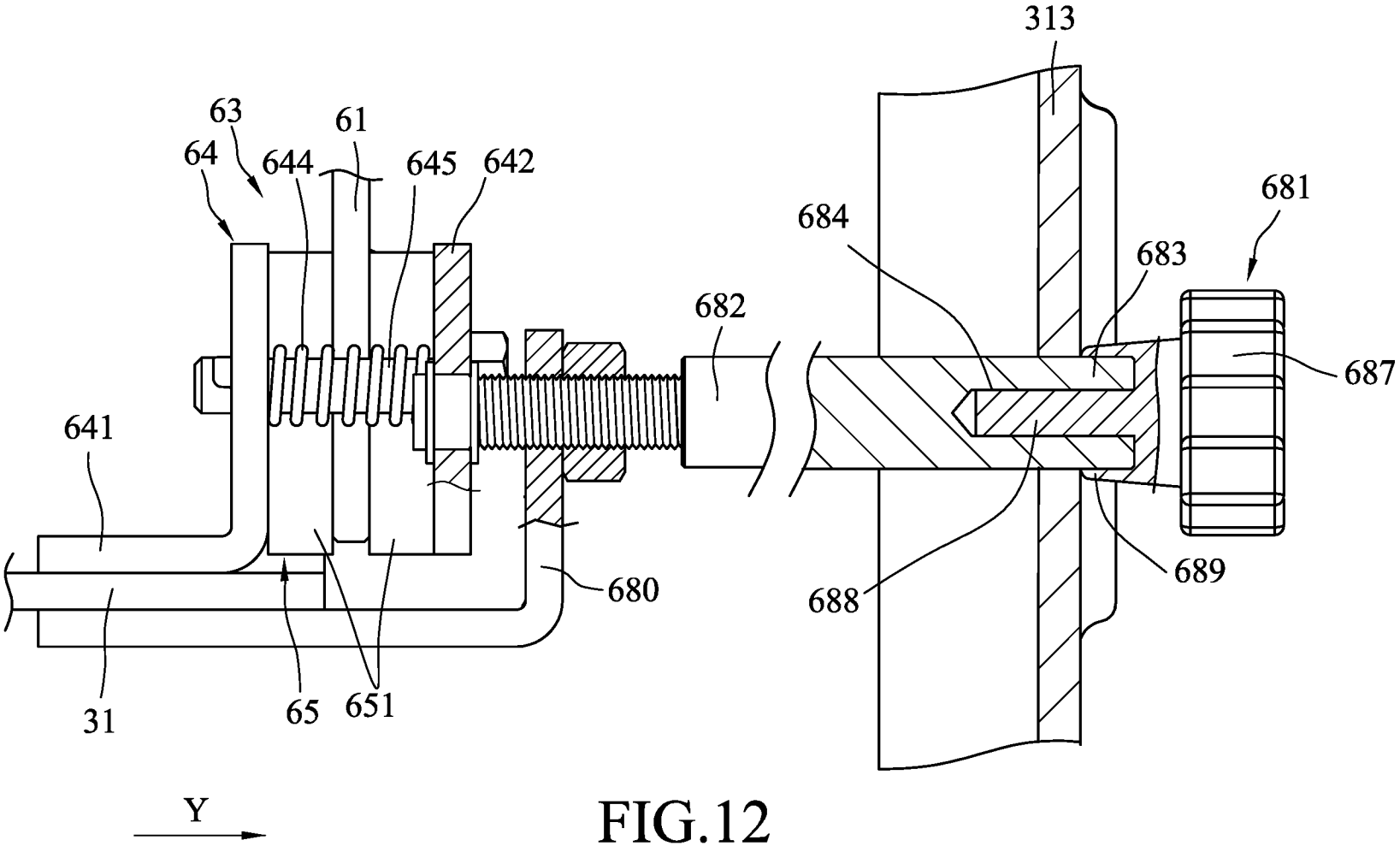
FIG. 12 illustrates a modification to the third embodiment.

In a modification of the third embodiment, the contact member 685 may be removed, so that the screw 682 directly abuts against the movable seat 642. Referring to FIG. 12, in another modification of the third embodiment, the screw 682 is rotatably engaged to the movable seat 642 without neither the contact member 685 nor the retaining member 686.

Overall, the implementation of the one-way damping device 6 in the treadmill 200 allows the user to do more types of exercises on the treadmill 200 without sacrificing the original safety design. The user may apply walking or running force onto the treadmill belt 5 to drive the top section 51 of the treadmill belt 5 to move in one of two opposite directions: one direction for regular running exercise, and the other direction for leg muscle training.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A treadmill comprising:

a base frame including a frame body that has a front end portion and a rear end portion opposite to said front end portion in a front-rear direction, and two rotating shafts that are respectively mounted to said front and rear end portions of said frame body, each of said rotating shafts being rotatable relative to said frame body about a rotational axis which extends in a left-right direction transverse to the front-rear direction;

a treadmill belt trained on said rotating shafts and having a top section that is defined between top ends of said rotating shafts, said top section being rearwardly movable around said rotating shafts to drive each of said rotating shafts to rotate about the rotational axis in a first rotational direction, and being forwardly movable around said rotating shafts to drive each of said rotating shafts to rotate about the rotational axis in a second rotational direction which is opposite to the first rotational direction; and an one-way damping device including a braking plate that is rotatable about a rotational axis extending in the left-right direction, an one-way clutch that is sleeved on the one of said rotating shafts, that is not engaged with said braking plate when said top section of said treadmill belt is moved rearwardly, and that is engaged with said braking plate when said top section of said treadmill belt is moved forwardly such that rotation of the one of said rotating shafts in the second rotational direction drives said braking plate to rotate in the second rotational direction via said one-way clutch, and a resistance unit that is fixedly mounted to said frame body and that abuts against said braking plate so that, when said top section of said treadmill belt is moved forwardly, said braking plate is rotated in the second rotational direction against a frictional force between said braking plate and said resistance unit.

2. The treadmill as claimed in claim 1, wherein said resistance unit includes a friction producing subunit that abuts against said braking plate for generating the frictional force; and an adjusting subunit that is fixedly mounted to said frame body, that is connected to said friction producing subunit, and that is operable to adjust a magnitude of the frictional force.

3. The treadmill as claimed in claim 2, wherein:

said adjusting subunit has a stationary seat that is fixedly mounted to said frame body, a movable seat that is spaced apart from said stationary seat in the left-right direction, said stationary seat and said movable seat being disposed respectively at opposite sides of said braking plate, and at least one adjusting member that extends in the left-right direction, that interconnects said stationary seat and said movable seat, and that is operable to adjust a distance between said stationary seat and said movable seat; and said friction producing subunit includes two resistance members that are respectively and fixedly connected to said stationary seat and said movable seat, and that cooperatively clamp said braking plate therebetween.

4. The treadmill as claimed in claim 3, wherein said adjusting subunit further has a resilient member that has two opposite ends respectively and resiliently abutting against said stationary seat and said movable seat.

5. The treadmill as claimed in claim 3, wherein said adjusting subunit has two of said adjusting members that are spaced apart in the front-rear direction, that threadedly engage said stationary seat and said movable seat, and that are rotatable to move said movable seat in the left-right direction relative to said stationary seat.

6. The treadmill as claimed in claim 3, wherein said drag adjusting subunit further has a driver that is connected to said at least one adjusting member and that is operable to be turned on for driving said at least one adjusting member to adjust the distance between said stationary seat and said movable seat, and a controller for facilitating operation of said driver.

7. The treadmill as claimed in claim 2, wherein:

said adjusting subunit has a stationary seat that is fixedly mounted to said frame body, at least one guiding member that extends in the left-right direction and that is mounted to said stationary seat, a movable seat that is connected to said at least one guiding member and that is movable in the left-right direction relative to said stationary seat, an adjusting base that is fixedly mounted to said frame body and that has a coupling segment being disposed at a side of said movable seat which is opposite to said stationary seat in the left-right direction and being spaced apart from said movable seat, and an adjusting screw subunit that threadedly extends in the left-right direction through said coupling segment of said adjusting base, and that is rotatable relative to said adjusting base to push said movable seat toward said stationary seat; and said friction producing subunit includes two resistance members that are respectively and fixedly connected to said stationary sea and said movable seat, and that cooperatively clamp said braking plate therebetween.

8. The treadmill as claimed in claim 7, wherein said adjusting screw subunit has a screw that threadedly extends in the left-right direction through said coupling segment of said adjusting base, and that has one end for abutting against said movable seat to push said movable seat toward said stationary seat, and an knob that is co-rotatably and removably mounted to an opposite end of said screw.

9. The treadmill as claimed in claim 8, wherein said adjusting screw subunit further has a retaining member that is mounted to said screw, that expands radially and outwardly from said screw, and that prevents said screw to be disengaged from said adjusting base.

10. The treadmill as claimed in claim 7, wherein said adjusting screw subunit has a screw that threadedly extends in the left-right direction through said coupling segment of said adjusting base, and that has one end rotatably engaged to said movable seat, and an knob that is co-rotatably and removably mounted to an opposite end of said screw.

11. The treadmill as claimed in claim 7, wherein said adjusting screw subunit has:

a screw that threadedly extends in the left-right direction through said coupling segment of said adjusting base;

a contact member that is mounted to one end of said screw for abutting against said movable seat to push said movable seat toward said stationary seat;

a retaining member that is mounted to said screw, that is disposed at a side of said contact member opposite to said movable seat, that expands radially and outwardly from said screw, and that prevents said screw to be disengaged from said adjusting base; and an knob that is co-rotatably and removably mounted to an opposite end of said screw.

12. The treadmill as claimed in claim 7, wherein said adjusting subunit further has a resilient member that has two opposite ends respectively and resiliently abutting against said stationary seat and said movable seat.

13. The treadmill as claimed in claim 1, further comprising a handrail unit that includes at least one upright support frame that has a bottom end connected fixedly to said frame body, and a handgrip that is mounted to a top end of said at least one support frame.

14. The treadmill as claimed in claim 13, wherein:

said handrail unit includes two of said supporting frames that are fixedly and respectively mounted to opposite left and right ends of said frame body of said base frame; and said handgrip has two side rail sections that extend in the front-rear direction and that are respectively and fixedly mounted on top ends of said supporting frames, a front rail section that extends in the left-right direction and that interconnects front ends of said side rail sections, and two hook-shaped tail sections, each of which has a first part extending downwardly from a rear end of a respective one of said side rail sections, and a second part extending forwardly from a bottom end of said first part.

* * * * *